US005267663A

United States Patent [19]

Dykhouse

[11] Patent Number: 5,267,663

[45] Date of Patent: Dec. 7, 1993

[54] COLLAPSIBLE SHIPPING CONTAINER

[76] Inventor: Howard J. Dykhouse, 7205 Arthur Rd. Box 68, Coopersville, Mich. 49404-0068

[21] Appl. No.: 937,544

[22] Filed: Aug. 28, 1992

[51] Int. Cl.[5] ..... B65D 19/06; B65D 6/00

[52] U.S. Cl. ..... 220/4.28; 206/600; 206/501; 206/508

[58] Field of Search ..... 206/600, 386, 501, 508; 226/4.28

[56] References Cited

U.S. PATENT DOCUMENTS

| | | | |
|---|---|---|---|
| 2,534,010 | 12/1950 | Frye | 206/600 |
| 2,806,594 | 9/1957 | Muller et al. | 206/600 |
| 4,311,239 | 1/1982 | Schlicker | 206/600 |
| 4,392,606 | 7/1983 | Fremion | 206/600 |
| 4,454,946 | 6/1984 | Yokowo | 206/600 |
| 4,643,314 | 2/1987 | Kidd | 206/600 |
| 4,763,787 | 8/1988 | Koenig | 206/600 |
| 4,960,209 | 10/1990 | Tudor | 206/600 |
| 5,133,460 | 7/1992 | Shuert | 206/600 |

*Primary Examiner*—Joseph Man-Fu Moy
*Attorney, Agent, or Firm*—Gifford, Groh, Sprinkle, Patmore & Anderson

[57] ABSTRACT

A collapsible shipping container formed on a supporting pallet and made up of a base and cover tray, separator members and rectilinear partition tubes, all made of sheet material such as corrugated paper. The separator members are made up of a pair of trays fixed to each other to form a cover for a lower layer of partition members and a receiving tray for an upper layer of partition members. All of the sheet material elements are foldable for stacking in a folded condition in the order in which they are used for movement as a unit to the packing area where packing is accomplished by removing layers of the folded components in the order of which they are used to erect an interlocked shipping container in which the various layers of material resist shifting relative to each other.

14 Claims, 2 Drawing Sheets

COLLAPSIBLE SHIPPING CONTAINER

FIELD OF THE INVENTION

This invention relates to storage or shipping containers and more particularly to pallet type containers which can be folded and unfolded for repeated use.

DESCRIPTION OF THE PRIOR ART

It frequently is necessary to pack articles for shipment or transport to location where the articles are unpacked for assembly with other parts. Often such parts are finely finished and require special handling to prevent marring or damage during transport. Examples of container structures used for such purposes can be found in U.S. Pat. No. 2,534,010 and 2,620,117. The disclosed arrangements permit the loading of articles in layers on pallets but their construction requires special die cutting and folding operations to produce the components of the shipping container.

SUMMARY OF THE INVENTION

In the present invention, the advantage of a layered, foldable shipping container are attained by a construction in which all of the components are formed with a minimum of scoring and die cuts to form a relatively rigid, protective container in which the various components are interlocked together to prevent lateral shifting during transport and to provide a reinforced structure permitting stacking of containers upon each other.

The advantages of the invention are attained by an assembly of folded corrugated paper components. Only two types of such corrugated paper components are required, namely trays and partition tubes. The trays are made up of a panel with foldable sides which unfold to form a shallow box-like tray. One such tray is used for the base member or bottom member of each layer of the shipping container and another tray is used for a cover. Also, the same form of trays are fastened together in pairs to make separators which are disposed between layers to cover a lower layer of partition members and receive an upper layer of partition members. The partition members are formed by the second type of corrugated paper structure or tube. These are rectilinear components having opposed walls with an open top and open bottom and with the walls being foldable relative to each other to a flat collapsed condition. In an unfolded condition, the partition members are arranged in side by side relation to engage each other and the edges of the trays to receive material to be packed. All of the components making up the container can be folded and stored in a stacked fashion in layers to occupy a minimum of space. The shipping containers also are made available in sets or kits so that the various components of a container are arranged in the order in which they are used at the packing site. At the packing site, the container is erected and packed for transport without the need for binding, banding or lashing. At the unpacking or unloading site the various components can be removed, folded and stacked in layers in readiness for reuse.

DESCRIPTION OF A PREFERRED EMBODIMENT

The shipping container embodying the present invention is designated generally at 10 and includes a base member 12 in the form of a pallet typically made of wood and adapted to be engaged and transported by forklift trucks. Disposed on the pallet 12 are trays 14 made of corrugated paper and held in spaced apart relationship to each other by corrugated paper tubes 16.

Figure 4:
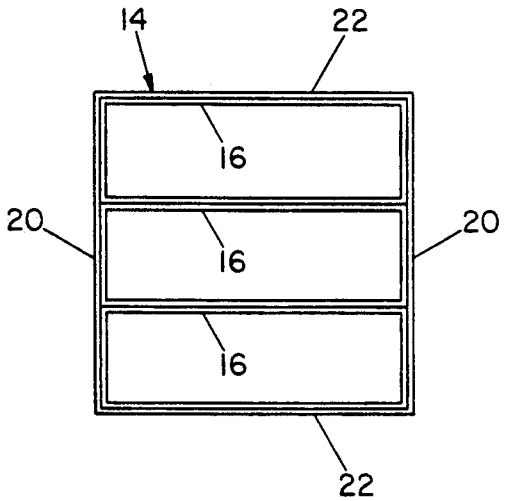
FIG. 4 is a top view at a reduced scale of the components seen in FIG. 3.
Figure 5:
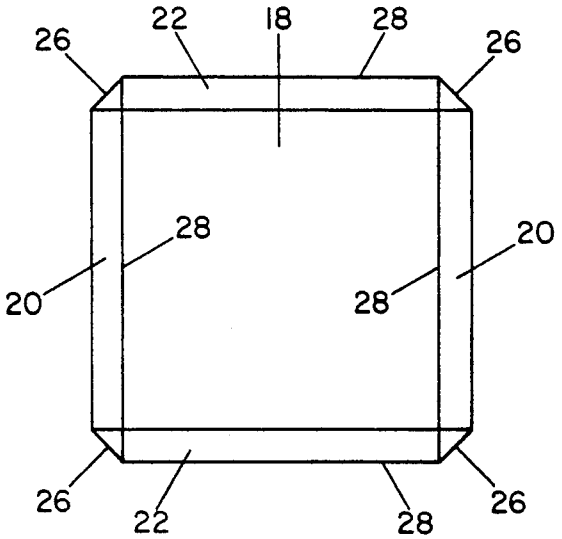
FIG. 5 is a top view of one of the trays making up the container in its collapsed condition.

The trays 14 are made of sheet material such as corrugated paper and each includes a base portion or panel 18 and opposed pairs of side walls 20 and 22, as best seen in FIG. 4 and 5. The side walls 20 and 22 are joined together at the corners 24 to form a box like structure. The ends of each of the opposed pair of side walls 20 are provided with fold lines 26 which extend at a 45 degree angle from the base panel 18. The perimeter of the base panel 18 and the adjoining side walls 20 and 22 are formed integrally with each other and permit folding along scored perimeter lines 28. This permits the opposed side walls 20 and 22 to be folded relative to the base panel so that the opposed panels 20 extend outwardly from the base panel 18 and are disposed in substantially the same plane as the base panel 18, as best seen in FIG. 5. At the same time, the opposed pair of side panels 22 are folded inwardly toward each other to lie on top of the base panel 18. The trays can be unfolded from the folded condition shown in FIG. 5, to the unfolded condition shown in FIG. 4 by lifting the sides 22 to a position perpendicular to the panel 18. This pulls the sides 20 to a similar position so that a box like structure is formed.

Figure 3:
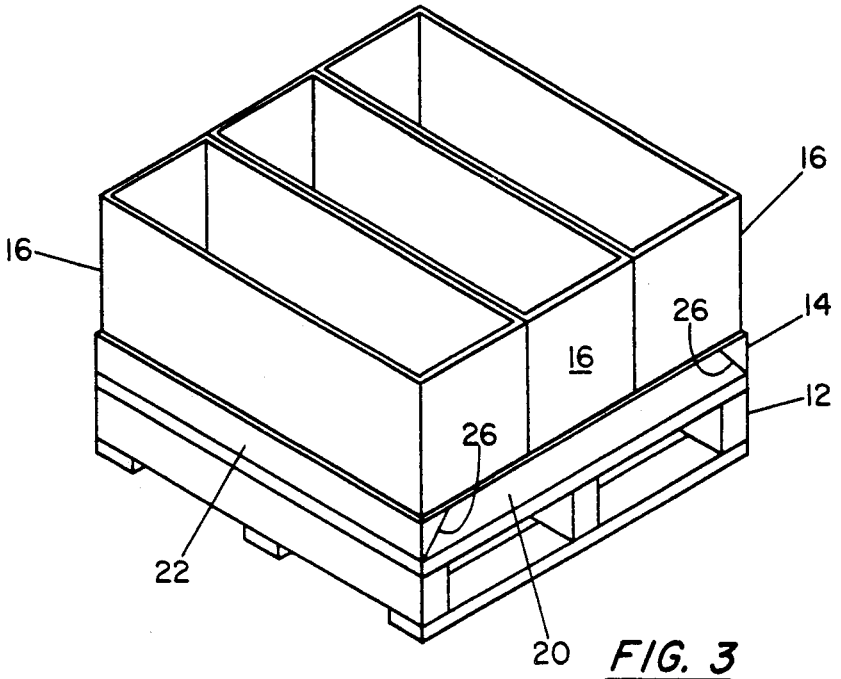
FIG. 3 is a perspective view of the container showing a bottom layer in readiness to receive articles to be packed.
Figure 6:
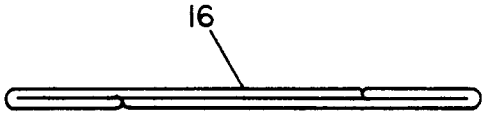
FIG. 6 is an end view of the partition or tube components making up a part of the container.

The open trays 14 receive the lower ends of tubes or sleeves 16. The tubes 16 act as partition elements to keep articles in the container 10 separated from each other and also act to support a covering tray 14. The tubes 16 or sleeves are generally rectilinear and have opposed, parallel side walls and open bottoms and tops. The tubes 16 are foldable as shown in FIG. 6 so that they can lie in a substantially flat condition when not in use. The open tubes 16 are arranged to occupy the entire space provided by the base panel 18 within the confines of the opposed side walls 20 and 22. As shown in FIG. 3, three tubes 16 occupy the tray 14. Other configurations of tubes 16 can be used. For example, a single tube confining the perimeter of the base 18 and abutting the side walls 20, 22 could be used. Similarly, a greater number of tubes might be used to define smaller article receiving compartments.

Figure 1:
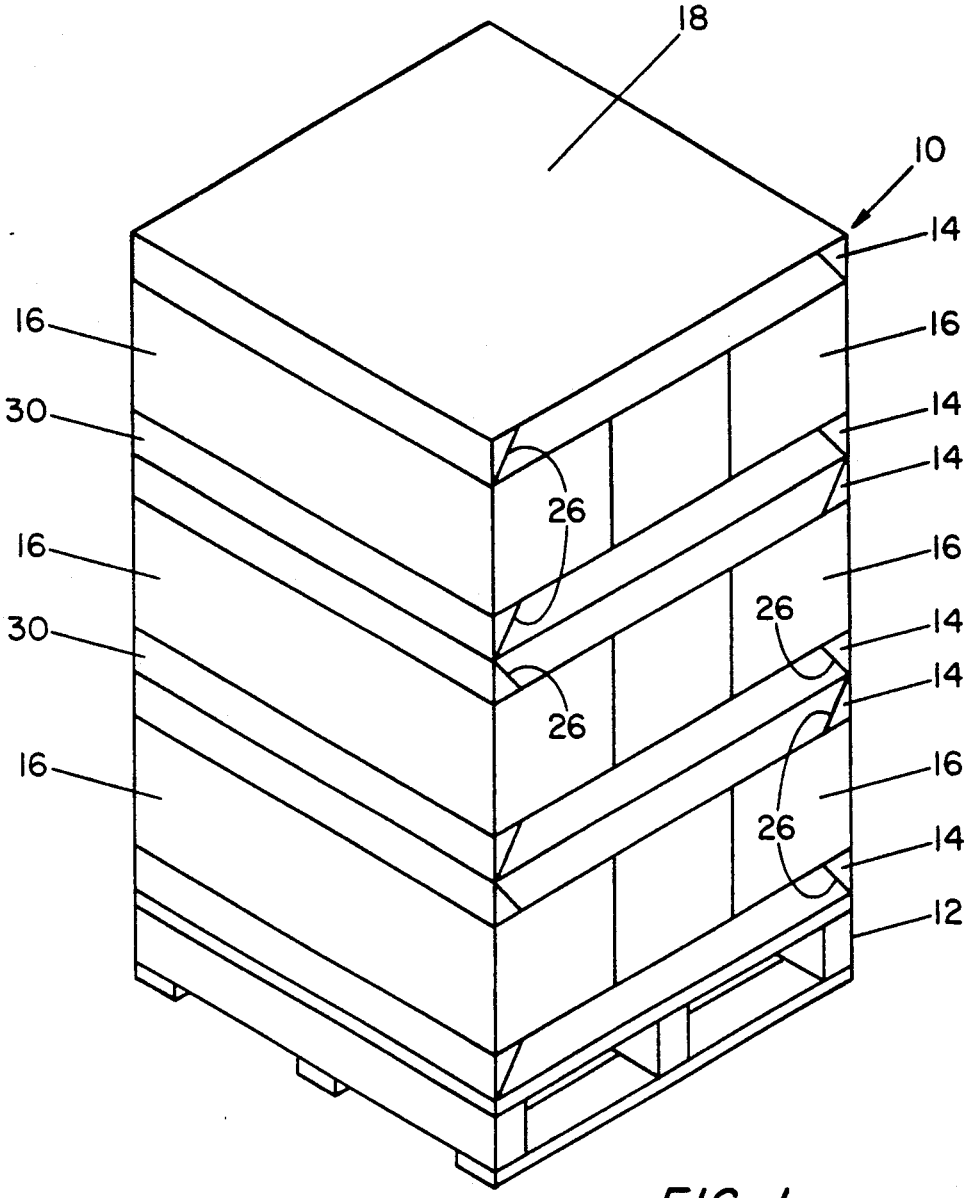
FIG. 1 is a perspective view of the container embodying the invention showing it as it would appear in its packed condition.

Referring now to FIG. 1, shipping carton or container 10 is illustrated having three layers of partition tubes 16. In that arrangement, the bottom tray 14 is fastened to the pallet 12 in any conventional manner by adhesive or staples or the like. The lower and middle layer of tubes 16 are separated by separator assemblies 30. The separators 30 are made up of a pair of trays 14 with their base portions 18 abutting and attached to each other by adhesive or the like. A first separator 30 is positioned so that the lower, downwardly opening tray 14 acts as a cover for the tubes 16 in the first layer and the upper tray 14 opens upwardly to receive the lower ends of unfolded tubes 16 forming the second material receiving layer. Similarly, a second separator 30, made up of a pair of trays 14 is disposed between the second and third layer of tubes 16. The top layer of tubes 16 is covered by still another tray 14 which is positioned to open downwardly so that the sides 20 and 22 envelope the tubes 16 and form a cover.

The entire assembly made up of the pallet 12, the trays 14, the separator members 30 and the tubes 16 forming the various layers of the shipping container 10 are interlocked together so that the load does not shift laterally during movement from location to location.

Figure 2:
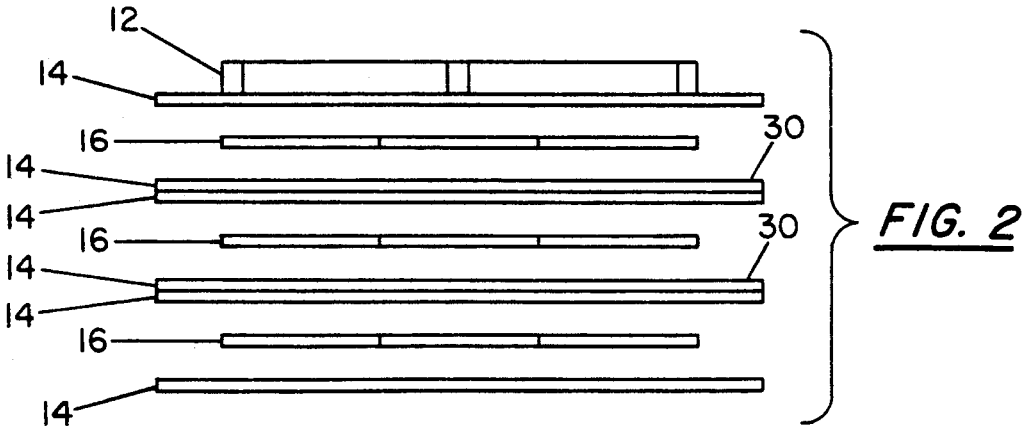
FIG. 2 is an exploded, diagrammatic view of various components of the container folded and disposed in layers as they would be prior to use.

To facilitate its use, the shipping container 10 can be made available in a kit form as illustrated diagrammatically in FIG. 2. In such a kit the various components of the shipping container 10 are arranged in the order in which they are used. The various components of the shipping container 10 are in their collapsed condition with the top tier being formed by an inverted pallet 12 with its attached tray 14. The next tier is formed by collapsed tubes 16 which rest on a collapsed separator 30 made up of back to back trays 14. Below this is a tier of tubes 16 resting on another separator 30 which rests on a tier of tubes 16. The bottom tier is formed by a tray 14 which forms the cover member for the shipping container 10. Since all of these components are in their collapsed condition they can be stacked on each other in a small space. As a consequence several of such kits, each making up a shipping containers 10 can be stacked one on the other and shipped to the point of use.

At the packing area the tiered kit arrangement shown in FIG. 2 is utilized by removing the top tier in the form of the pallet and attached tray 14 and locating the pallet in a selected position. Thereafter, the sides of the attached tray are unfolded to form an open, box-like construction. The next available tier in the kit are the tubes 16 which also are unfolded to their open condition and located within the confines of the side walls of the tray 14. After the compartments afforded by the tubes 16 are packed with articles to be shipped or stored, a separator 30 is removed from the stack. The lower tray 14 of the separator 30 is unfolded so that the sides embrace the tops of the tubes 16 to act as a cover for the tubes and the packed contents. The upper portion of the separator 30 formed by a tray 14 is unfolded and the next layer of tubes is arranged within the confines of the opposed side walls 20 and 22. These compartments also can be filled with articles and covered in the same manner by a separator member 30 to receive still another layer of tubes 16. After the desired number of layers has been erected and loaded the topmost layer of tubes 16 can be covered with a tray 14 which is the remaining tier in the stack forming the container kit.

If desired the packed container 10 can be banded or lashed together even though the tubes and trays are interlocked to form a structure which resists lateral shifting movement of any one of layers relative to the other or any of the layers relative to the pallet 12.

It will be noted that the container is strong vertically as well as horizontally in that the panels 18 in the separator 30 form a double wall on which the packed material rests. This double wall is further supported by the underlying walls of the tubes 16. As seen for example in FIG. 3, three tubes 16 are used in a layer so that the walls act as a support between the lower tray and the covering tray. The strong vertical structure makes it possible to stack pallets on each other to save floor space in a packing location. When a container 10 arrives at a shipping destination it can be unpacked in the reverse order of packing. If, for example, the cover formed by the tray 14 is removed and folded to a collapsed condition and after the articles are removed from the top layer of tubes 16, the partition or tube members 16 can be removed and folded to a flat condition and located on the cover tray. Thereafter, the uppermost separator 30 can be removed and collapsed and placed on the layer of tubes 16 in the stack. When the lowermost layer is unpacked the tray 14 attached to the pallet 12 can be collapsed and the entire unit inverted and placed on the top of the stack to form a kit which can be stacked on other kits and returned to the packing location.

It will be seen that a shipping container has been provided in which the principle components are made of collapsed paper panels such as corrugated paper and the construction is such that lateral shifting of articles placed within the container is resisted so that it is unnecessary to band or lash the fully packed container. Also, the container may be collapsed after use for return to a packing location.

A shipping container 10 is made up of rectilinear panels of corrugated paper which requires a minimum of cutting so that a very high volume protective shipping container can be formed with a minimum of waste which otherwise results from special configurations requiring die cuts. Also, lateral shifting is resisted between layers of packed materials by locking the opposite ends of open ended tubes or partition member within the walls of trays with the lowermost tray of the container being fixed to a supporting pallet by adhesive or staples and with the cover and base tray disposed between layers of packed material being fixed to each other to form a unitary separator member. Only two basic components in the form of trays and tube members are used to provide the base, cover, separators and partition members.

I claim:

1. collapsible shipping container comprising:

a platform member a first foldable tray fixed to said platform having opposed foldable side walls joined together at adjoining corners and opposed foldable said tray opening upwardly in an unfolded condition, a first set of foldable partition elements fitted into said tray and forming a first material receiving layer in an unfolded condition of said partition elements, a separator member comprising a pair of foldable trays fixed together to open in opposite directions in the unfolded condition, one of said folded trays of said pair forming a cover for said first layer and the other of said pair of trays forming an upwardly opening second tray, a set of foldable partition elements received in said second tray and forming a second material receiving layer in an unfolded condition of said second set of partition elements, and a foldable tray formed by a selected one of a cover portion of a second separator member or a separate cover tray disposed on said second layer to form an interlocked shipping container, said first foldable tray, said pair of foldable trays forming said separator member and said cover tray being identical to each other.

2. The combination of claim 1 in which each of said trays comprises a rectilinear base portion and foldable edge elements joined together to form closed corners and defining the perimeter of said base portion.

3. The combination of claim 2 wherein said separator members are formed by a pair of trays having their base members fastened to each other.

4. The combination of claim 1 wherein said partition elements are formed by walls attached to each other and foldable to a substantially flat condition, said partition elements defining said layers for receiving materials to be shipped in an unfolded condition of said tubes.

5. The combination of claim 4 wherein said unfolded partition elements occupy all of the area defined by said perimeters of said base portions.

6. The combination of claim 1 wherein said trays, said partition elements and said separator members each are foldable to a substantially flat condition and are stacked on each other in their folded condition.

7. The combination of claim 6 wherein all of said foldable components are stacked in a flat condition on each other in the order in which they are unfolded for use.

8. The combination of claim 7 wherein said cover member forms a first tier in a folded condition on the bottom of said stack, said partition elements form a second tier in the folded condition of said partition elements, a separator member in its folded condition forms a third tier, said partition elements in their folded condition form a fourth tier, and a tray member attached to a base member forms the top tier.

9. The combination of claim 8 wherein the cover member of a second group of components forming a shipping container are placed on a platform member of a preceding group of container components.

10. The combination of claim 9 wherein said platform member is disposed with its foldable tray folded and facing downwardly.

11. The combination of claim 1 wherein said trays have a box like construction with a rectilinear bottom panel and peripheral side walls, opposed walls of said trays being foldable to position substantially parallel to said base.

12. The combination of claim 11 wherein a pair of opposed walls are foldable outwardly to lie in the plane of said base and the other pair of opposed walls are foldable to a position on top of said panel.

13. The combination of claim 1 wherein said trays are of a box like construction having a rectilinear bottom panel and peripheral side walls, a pair of opposed side walls having a fold line extending substantially 45 degrees from said panel at the juncture of said opposed side walls with the adjacent side walls.

14. The method of loading a pallet with parts for transport comprising the steps of:

(1) placing a pallet in a selected position,
(2) unfolding a foldable tray attached to said pallet so that the tray opens upwardly,
(3) unfolding foldable partition elements and arranging them in said tray to form a first layer for receiving materials to be transported,
(4) placing objects to be transported in said unfolded partition elements,
(5) unfolding the edges of a first separator tray forming part of a separator member and placing said first separator tray on said first layer of partition elements to cover the later,
(6) unfolding the edges of a second separator tray attached to said first separator tray and forming the remaining part of said separator member,
(7) unfolding partition elements and placing them in said open second separator tray to form a second layer,
(8) repeating steps 4,5,6 and 7 until a final layer is formed, and
(9) covering said final layer of separator elements with an unfolded tray.

* * * * *

UNITED STATES PATENT AND TRADEMARK OFFICE

CERTIFICATE OF CORRECTION

PATENT NO. : 5,267,663

DATED : Dec. 7, 1993

INVENTOR(S) : Howard J. Dykhouse

It is certified that error appears in the above-identified patent and that said Letters Patent is hereby corrected as shown below:

Column 4, line 46, "collapsible" should read --A collapsible--.

Column 4, line 48, "platform having" should read --platform, said tray having--.

Column 4, line 50, "opposed foldable said tray" should be deleted.

Column 5, line 12, "claim 1" should read --claim 2--.

Column 5, line 17, "said tubes" should read --said partition elements--.

Signed and Sealed this

Thirty-first Day of October 1995

*Attest:*

*Attesting Officer*

BRUCE LEHMAN

*Commissioner of Patents and Trademarks*